US008499765B2

(12) United States Patent
Fallon

(10) Patent No.: US 8,499,765 B2
(45) Date of Patent: Aug. 6, 2013

(54) PROCESS FOR PRODUCING SMOKELESS TOBACCO POUCHES AND DEVICE FOR PERFORMING THE SAME

(75) Inventor: Gary Fallon, London (GB)

(73) Assignee: British American Tobacco (Investments) Limited, London (GB)

( * ) Notice: Subject to any disclaimer, the term of this patent is extended or adjusted under 35 U.S.C. 154(b) by 772 days.

(21) Appl. No.: 12/598,727

(22) PCT Filed: Apr. 29, 2008

(86) PCT No.: PCT/EP2008/055274

§ 371 (c)(1),
(2), (4) Date: Apr. 26, 2010

(87) PCT Pub. No.: WO2008/135469

PCT Pub. Date: Nov. 13, 2008

(65) Prior Publication Data

US 2010/0200005 A1 Aug. 12, 2010

(30) Foreign Application Priority Data

May 4, 2007 (SE) ..... 0701088

(51) Int. Cl.
*A24B 1/10* (2006.01)

(52) U.S. Cl.
USPC ..... 131/112

(58) Field of Classification Search
None
See application file for complete search history.

(56) References Cited

U.S. PATENT DOCUMENTS

| | | | | |
|---|---|---|---|---|
| 3,006,764 | A * | 10/1961 | Stephenson et al. | 426/78 |
| 4,703,765 | A | 11/1987 | Paules et al. | |
| 2003/0050166 | A1 | 3/2003 | Dominguez, Jr. et al. | |

FOREIGN PATENT DOCUMENTS

| | | | |
|---|---|---|---|
| EM | 000019328-0001 | | 5/2003 |
| WO | WO2005/104881 | A | 11/2005 |
| WO | 2006/120570 | A8 | 11/2006 |
| WO | WO2006/120570 | A | 11/2006 |
| WO | 2007/037962 | A1 | 4/2007 |

OTHER PUBLICATIONS

International Search Report and Written Opinion, mailed Jul. 9, 2008, for International Application No. PCT/EP2008/055274, filed Apr. 29, 2008.
International Preliminary Report on Patentability, issued Nov. 10, 2009, for International Application No. PCT/EP2008/055274, filed Apr. 29, 2008.
International Search Report and Written Option, mailed on Jul. 9, 2008.

* cited by examiner

*Primary Examiner* — Michael J Felton
(74) *Attorney, Agent, or Firm* — NW Poulsen

(57) ABSTRACT

Easier handling during packing and reduced pouch spotting is seen when a moist smokeless tobacco product is at a sub-refrigeration temperature during formation and sealing of portioned product.

44 Claims, No Drawings

PROCESS FOR PRODUCING SMOKELESS TOBACCO POUCHES AND DEVICE FOR PERFORMING THE SAME

CLAIM FOR PRIORITY

This application is a National Stage Entry entitled to and hereby claims priority under 35 U.S.C. §§365 and 371 corresponding to PCT Application No. PCT/EP2008/055274, titled, "Improved process for producing smokeless tobacco pouches and device for performing the same," filed Apr. 29, 2008, which in turn claims priority to Swedish Application Ser. No. SE 0701088-7, filed May 4, 2007, all of which are hereby Incorporated by reference.

FIELD OF THE INVENTION

The invention relates generally to the field of smokeless tobacco products. More specifically, the invention relates to packaging individual units of moist smokeless tobacco products.

BACKGROUND OF THE INVENTION

Among the broad array of tobacco products offered on the market today there is a class of goods intended for oral administration which do not require combustion. Within this class are snus products, some of which are provided in a pouch-like format. Each individual unit of snus is portioned into a fleece material which is sealed shut to form a filled pouch. A plurality of such pouches are placed in a container and provided to consumers.

The technology and materials for forming pouches of snus are similar to those techniques used to form tea bags. In the standard procedure, a piece of packing equipment provides a tube of thermoreactive fleece which is sealed at a bottom end, An injection or directed burst of metered snus product is placed toward the closed end of the tube, and a heat seal is made in the fleece above the top of the snus portion. An additional metered amount of snus product is placed above the heat seal, and the process continues to form a tape with a plurality of doses of snus product contained lengthwise therein. A cutting means separates the tape into individual units by cutting along each heat seal, resulting in rectangular pouches of snus. This is a widespread method but variations are known in the art.

In some versions of portion snus, the finished product is a rectangular white fleece pouch with a portion of dark tobacco visible through the fleece. Due to the high moisture content of snus, and particularly when influenced by storage or packaging conditions, liquid can seep from the snus and result in dark or brown coloured spots on the fleece. At least one cause of spotting is moisture leach from tobacco during heat sealing of the fleece that forms the pouch. The current method also results particles of snus being caught in the heat seal itself, causing spotting along the seam and material waste due to rejected pouches.

Pouches with snus particles trapped in the sealed seams and pouches with spots are less aesthetically appealing for consumers who may regard such goods as damaged, defective, or otherwise not ideal for consumption. Furthermore, the cumbersome nature of moist snus which contributes to these problems and also poses challenges for manufacturing such as clogging and sticking during handling. Because of the commercial nature of the product, skilled persons have proposed various solutions to these problems.

One line of teachings has been directed at reducing the moisture in the snus, thereby reducing the likelihood of seepage or moisture migration which is a source of spotting. Reduced moisture snus also avoids certain problems with snus clumping in the packing machinery. U.S. Pat. No. 4,703,765 discloses a device for injecting snus via a fill tube into a tubular fleece, welding transverse seams in the fleece then severing the welded areas to provide a plurality of heat sealed snus portions. The reference teaches that the moisture contents of the snus must not exceed 30%. Since the end product should ideally have a moisture content of about 50%, the portioned fleece-wrapped snus is sprayed with liquid to remoisturize the product from the outside.

Other sources have taught that because the heating of moist snus during the heat sealing process that forms the pouches is the contributory factor to spotting, this step should be reengineered or avoided. For example, RCD 000019328-0001 shows a snus pouch design in which a heat seal can be made along a portion of the fleece that is at a distance from the snus, then the sealed seam can be folded back against the pouch. Any residual heat from the sealing might encourage spotting, but as the seam lies along the pouch it forms a multi-layer fleece where the outer layer might not show the spots on the plural layers nearer the snus.

Despite advances in low-moisture snus and alterations to the location and type of heat seals, there remains a need in the art to provide improvements which will offer a snus product which offers ease of handling while also reducing the problem of spotted snus pouches.

SUMMARY OF THE INVENTION

It is therefore an object of the present invention to provide an improved portioned smokeless tobacco product which avoids the problems of the prior art.

According to an embodiment of the invention, a method for preparing a portioned smokeless tobacco product is provided which comprises the steps of providing units of a snus product to a wrapping material and sealing the wrapping material around the units of snus, where the method comprises cooling at least a portion of the snus product to a temperature of 0° C. or below prior to the sealing step. The sealing could comprise heating. The cooling step could comprise cooling the snus product to a temperature of −5° C. or below, for example −10° C. or below. The wrapping material could be provided in a tube or tape form, in which case the method could further comprise dividing the sealed wrapped snus product into separate units of sealed wrapped snus product. The providing step could comprise placing the units of the snus product on a first sheet of a wrapping material in a chosen configuration and covering the snus product on the first sheet of wrapping material with a second sheet of wrapping material. For example, the configuration could be rectangular, square, circular, or kidney-shaped.

The cooling step could comprise at least one method selected from the group consisting of treating the snus product with cooled gas, use of an air-cooling conveyer, use of a chill roller, and spray freezing. The cooling step could last at least 1 second, such as at least 2 seconds, at least 5 seconds, at least 10 seconds, at least 20 seconds, at least 30 seconds, at least 45 seconds, at least 60 seconds, at least 90 seconds, at least 120 seconds, at least 3 minutes, at least 5 minutes, at least 10 minutes, at least 15 minutes, at least 20 minutes, at least 30 minutes, or at least 45 minutes. The cooling step could last a maximum of 30 seconds, such as at least 45 seconds, at least 60 seconds, at least 90 seconds, at least 120 seconds, at least 3 minutes, at least 5 minutes, at least 10 minutes, at least 15 minutes, at least 20 minutes, at least 30 minutes, at least 45 minutes, or at least 60 minutes.

The wrapping material could be a non-woven fleece.

As used herein "heat sealing" refers to any method in which a material is treated with a temperature higher than the ambient temperature material to effect a sealing-, joining- or closing-type action. The process causes the material or elements of the material to fuse or otherwise form or rearrange connections such that a seal or bond is formed. Examples include locating a flexible or fluidized adhesive between two layers of material. As heat is applied the adhesive cures thus forming a bond between the two layers. Another example would be a non-woven fleece material comprising some portion of polyethylene fibers. While compressing two or more layers of the fleece together and applying heat, the polyethylene component of the layers in the heated and compressed region becomes fluidized and upon cooling will solidify to form a bond between the layers in the region of heating. It should be noted that materials normally used at a refrigerated temperature (4° C.) might be "heat sealed" at a temperature of e.g., 8° C., or materials normally used at body temperature (37° C.) might be "heat sealed" at a temperature of e.g., 45° C. That is, the use of the term "heat sealing" can imply temperatures substantially in excess of the operating temperature of the material, or it can imply only slightly elevated temperatures.

"Moist smokeless tobacco product" is used herein to denote tobacco products having at least 20% moisture and which are not intended for combustion. The moisture level in the product may include water, humectants, liquid additives such as flavourants, and/or other compounds or compositions. Known moist smokeless tobacco products include standard chewing tobacco, which typically has a moisture content of 20%, or 25%, or 30%, or 35%, or 40%, or 45%, or 50%, or 55%, or 60%; snus, which typically has a moisture content of 40%, or 45%, or 50%, or 55%, or 60%, or 65%, or 70%; and moist snuff, which typically has a moisture content of 20%, or 25%, or 30%, or 35%, or 40%, or 45%, or 50%, or 55%, or 60%. Additives may be incorporated in these products to reduce the overall moisture and/or water activity of the final product, however, for the purposes of this invention such final products would still be considered to comprise moist smokeless tobacco.

"Snus" is used herein to refer to one of the products which can be handled using the process of the present invention. It refers to a conventional well-known product commonly referred to as snus, but the use of the term is exemplary only and is not intended to limit the applicability of the invention.

"Tobacco" as used herein includes any part, e.g., leaves, flowers, stems, of any member of the genus *Nicotiana* and reconstituted materials thereof. It includes derivatives such as specific compounds found in natural tobacco, e.g., nicotine, whether extracted or synthesized, as well as structural derivatives such as the fibrous portion of a tobacco leaf. It further includes tobacco substitutes which comprise individual chemicals and/or complex chemical entities which, when appropriately prepared, physically resemble natural tobacco.

The term "wrapping material" can refer to any suitable material which forms a barrier or enclosure for the product enclosed therein. Examples of "wrapping material" applicable to the invention include woven or non woven fibres such as cellulose-based materials.

DETAILED DESCRIPTION

The production and packing processes for portioned smokeless tobacco products varies between manufacturers and products. However, a basic procedure for a snus product could be summarized as follows: cured and ground or finely chopped tobacco is blended with water and flavourants and heated for a period of time in a pasteurization-like reaction. The snus blend is then cooled to approximately refrigerated temperature (4° C.) and allowed to mature for a period of time, often about 48 hours. The cooled, matured snus is packed in pouches and the pouches placed in outer containers. In some cases the pouch packing occurs along a refrigerated production line. The containers of snus are held at approximately refrigerated temperatures during storage and transport.

A basic procedure for a chewing tobacco product could be summarized as casing a cured chopped tobacco with a casing solution comprising flavourants, humectants and sweeteners then maturing the blend at room temperature for a period of time such as 24 hours. The cased, cured chewing tobacco can then be packed in pouches and placed in outer containers. WO 07/37962 describes and summarizes a number of variables and parameters for portioned smokeless tobacco products known in the art; the reference is expressly incorporated by reference herein.

It has now been found that an intermediate cooling step can be performed on the moist smokeless tobacco prior to forming any pouches or wrapped units, which cooling step reduces the propensity of moisture release during the application of any heat, such as to seal an outer wrapping material, and therefore reduces spotting of the wrapping material during the packing step. The inventive method also results in a moist smokeless tobacco product which is easier to handle, reducing clumping and clogging of packing machinery and therefore minimizing equipment downtime and repair costs. Furthermore, the inventive methods results in a moist smokeless tobacco product that can be formed into precise shapes. This in turn reduces material waste which can further decrease costs.

The invention functions by chilling the moist smokeless tobacco product to approximately the freezing point of water or below, for example, to 0° C. or below. This effectively locks up the moisture in the snus product, giving it the physical handling characteristics of a much drier particulate material. Thus the product is easier for manufacturing equipment to handle as there is less stickiness and reduced processing complications. It may be preferred in some applications to also cool the equipment in contact with the chilled product so as to further benefit from the ease of handling offered by the invention.

It should be apparent to skilled workers that certain additives may affect the freezing point of the moisture in the moist smokeless tobacco product, the invention teaches that preferably at least half of the available moisture in the product is in at least a semi-solid state. It is the solidification of a reasonable portion of the moisture in the product which provides a moist smokeless tobacco which is easier to handle and resistant to spot formation during sealing.

Excessive reductions in the product temperature, e.g., −25° C., could potentially present an unnecessary use of energy and cause delays in the manufacturing process, although temperatures lower than those needed to see an improved product have not evidenced a significant decrease in product performance after returning to refrigerated temperatures. Those practicing the invention will find the method most suitable for cooling the moist smokeless tobacco and employ that method, regardless of whether it reduces the moist smokeless tobacco temperature just to the level required for the desired product performance or if it reduces the temperature significantly beyond that required.

As noted above, skilled workers have previously offered suggestions to problems of poor handling of moist smokeless tobacco products as well as problems of spotting. Where a manufacturer has implemented measures to address handling problems in such a way that only the spotting problem remains, cooling of the moist smokeless tobacco could be limited to the portion of the moist smokeless tobacco which is adjacent to the wrapping material. For example, in a standard snus packing process where the snus is injected into a formed tube of fleece material, the fleece tube with snus inside could be subjected to a cooling operation such that the cooling effect only reaches the surface layer of the snus. Alterations may be required in the temperature and/or timing of formation of the heat seal between portions as the fleece may demonstrate a lower temperature at the start of the process if it has been subjected to the snus cooling process. Similarly measures implemented to reduce spotting could still be supplemented with the inventive method to improve equipment performance and handling capabilities.

There are numerous ways to affect the cooling process of the invention. A skilled worker will appreciate that smokeless tobacco products are consumables that are used like a food product, and in some places controlled like one. Accordingly, suitable materials should be used to handle and prepare products of the invention.

Duration and temperature ranges for cooling depend in large part on the volume of material being treated, the equipment used, and the particular physical properties of the materials. For example, a smokeless tobacco with a large percentage of heavy casing solution may require longer times and lower temperatures to achieve the desired result.

Methods and devices useful for effecting the invention include any known or developed means which can cool a moist smokeless tobacco product in a way that does not create long-term effects on product performance. Moist smokeless tobacco is intended for human oral administration and as such methods and materials which would result in contamination of the end product would not be preferred.

Examples of cooling methods and devices known in the art and applicable to the invention include jacketed vessels. Where jacketed vessels are employed in a current manufacturing process to heat the snus product during the heating step, these same vessels could be used to affect the temperature desired for the maturation phase (often refrigeration temperatures) and then used to further drop the temperature of the product prior to portioning.

Various mixers are also often employed in the moist smokeless tobacco production process, these mixers could be used in conjunction with a stream of cooled gas such as cold air or nitrogen which can rapidly cool a product during tumbling. In such a procedure, a skilled worker would take care to ensure the cooled gas is at a suitable temperature and used for a sufficiently short duration so as to not dry the product beyond an acceptable range. It may be necessary in some configurations to raise the pre-cooling moisture level of the product to account for moisture loss during the cooling process.

Where a conveyer line is used to transport moist smokeless tobacco product from the maturation area to the portioning and packaging area, this line could be provided with cooling means. For example, a stream of cooled gas could be pumped against the direction of flow of the moist smokeless tobacco product and/or the belt or chute transporting the product could be of a metal cooled to a sufficiently low temperature to effect a phase change for some of the moisture in the product. A skilled worker will appreciate that care should be taken to avoid or accommodate water build up which could form in such a system. If left unaddressed, stagnant water can facilitate microbial growth and/or be reintroduced in the product, thereby altering the moisture level.

Flash cooling processes are well known in the art of food processing and would be suitable alternatives for the present invention. A simple but nonetheless effective cooling means is to place the moist smokeless tobacco on conductive trays such as aluminium trays and stack the trays in a freezer. Non-stick coatings or liners may be provided to reduce the occurrence of product sticking to the trays.

Spray freezing processes are also known, for example with regard to coffee processing. At its essence, it is a four-step process. First, a primary freezing pre-chills the product down to a slushy stage, about −1° C. to −6° C. Then the pre-chilled smokeless tobacco slush is placed on a steel belt, trays, or drums. Using any suitable means the smokeless tobacco is cooled stepwise to between about −10° C. to −50° C. The speed of this process influences the size and appearance of the particles. Larger, darker particles can usually be formed with a slower process, perhaps 10-200 minutes, whereas a smaller and possibly slightly lighter particle can be formed when the cooling steps occur in rapid succession, over about 10-1000 seconds.

The product at this point is similar to a sheet of dark ice with trapped particles. The material is chopped or ground as desired to a chosen particle size. Sieving may be used. The particles are placed in a drying chamber where temperature and vacuum settings are used to vaporize the desired amount of moisture leaving drier, frozen particles ready for portioning.

As should be evident from the description, the present invention can often be accommodated in existing production lines with a minimum of alteration to the existing equipment and processes, however, it may be preferred for newly-built or upgraded production centres to have attention paid to fitting the production line with suitable equipment that carries out the invention is an economical and effective way.

Particularly with regard to the ability of moist smokeless tobacco to be handled as if it were a much drier product, the invention allows for new methods for portioning product. For example, standard rectangular pouches can be made according to existing methods and they will provide reduced complications with machinery and reduced spotting/reduced prevalence of particles trapped in the heat-sealed seams of the finished product as compared with conventional processes. But another option provided by the inventive method is that new processes for manufacture are permitted.

Using moist smokeless tobacco in which about half of the moisture is in a semi-solid or solid state, a new process can be performed in which a first layer of a wrapping material is extended across a substantially horizontal surface, a plurality of portions of cooled, moist smokeless tobacco product are arranged across the wrapping material, and a second layer of wrapping material is placed over the portioned product. The regions defining spaces between the various portions of product can be heat sealed such as with a low-heat laser or a roller ball pen-like instrument. The use of wrapping material is minimized and the easily handled moist smokeless tobacco product will not be located in the sealed seams, nor will it have caused spotting during the sealing process.

A further process now possible using the cooled, moist smokeless tobacco of the invention is to place a flat or contoured wrapping material in or over a moulded three dimensional shape, then fill the shape with product and possibly cover with a separate second layer of wrapping material before closing the mould and sealing the edges of the shape. An example is a spherical shape in which a piece of wrapping material is placed like a lining in a first half-sphere mould, then a portion of cooled, moist smokeless tobacco material is placed into the lined mould before an overlapping half-sphere mould lined with a wrapping material is placed over and around the upper edge of the first mould. The overlapping area could be heated to form a seal in the layers of wrapping material which would lie flush with the completed sphere once ejected from the mould.

While not specifically detailed herein, various forms of automation and computer control could be employed in the practice of the present invention. An example is a monitoring system to measure the temperature of the moist smokeless tobacco product and provide a cooling means only for the duration required to achieve a desired temperature.

EXAMPLE 1

Cooling Moist Smokeless Tobacco to 0° C. with Nitrogen Gas

A 1 kg batch of snus is produced according to known methods. The snus is moved along a conveyor line to a portioning and packaging area. The line comprises a moving belt within a closed metal tube approximately 5 meters in length. A gas inlet is provided near the end of the tube closest the portioning and packaging area, and a gas outlet is provided near the end of the tube closest the snus supply area.

The matured snus at approximately 4° C. is scattered thinly upon the moving belt as it advances into the metal tube. A slightly pressurized supply of nitrogen gas at approximately −20° C. (minus twenty degrees Celsius) is pumped into the tube via the gas inlet. The pressure in the gas is sufficient to force it in a counter current movement through the tube, but not so high as to disturb and displace the snus particles from the belt. The nitrogen gas passes over and around the moving belt and exits the tube via the gas outlet, to be re-cooled and recycled into the process.

The snus spends approximately five seconds passing through the tube and emerges at about 0° C. Approximately one-half of the moisture in the snus is in the solid or semi-solid state. Portioning and packaging equipment is in fluid communication with the conveyer line and receives the cooled snus. The equipment is maintained in a refrigerated area, meaning the majority of surfaces in contact with the cooled snus are at a temperature of approximately 4° C. Portioning and packaging are performed according to known methods, resulting in rectangular heat-sealed pouches of portion snus. The product is not spotted due to the heat sealing step and the machinery handling the cooled snus exhibits reduced clogging and reduced down time for cleaning and maintenance.

EXAMPLE 2

Cooling Moist Smokeless Tobacco to −5° C. with a Jacketed Vessel

A 5 kg batch of snus is produced according to known methods. The snus is matured at approximately 4° C. in a jacketed vessel provided with an internal stirrer. Once the maturing step is complete, the fluid used to cool the jacketed vessel is cooled to −40° C. (minus forty degrees Celsius). Under rapid stirring and rotation of the jacketed vessel, the snus is cooled to an average temperature of approximately −5° C. (minus five degrees Celsius) in a time period of approximately 5 minutes.

A portioning and packaging machine having an insulated top-loading hopper for moist smokeless tobacco is provided. The hopper portion is cooled to approximately −10° C. (minus ten degrees Celsius) by placing it in a commercial freezer. The cooled hopper is placed on the machine and the cooled snus is loaded into the hopper. A hollow, insulated lid for the hopper is filled with dry ice (solid $CO_2$ at approximately −110° C.) and sealed on the hopper.

The portioning and packaging machine disperses units of cooled snus according to a pre-determined pattern on a first layer of fleecy viscose having thermoplastic bonding agent dispersed therein. A second layer of fleecy viscose with thermoplastic bonding agent is placed over the snus and the regions of viscose in direct contact with one another (i.e., between the units of snus) are compressed and heated to form a seal.

Any compression or heating that extends over the snus-containing regions will not cause spotting as the moisture within the product is not sufficiently flowable to seep into the viscose. Furthermore, because the product is not in a sticky or adhesive state, compression will not result in a permanent adherence of product and an undesirably hard finished product as would otherwise occur. Instead, the individual particles of snus will remain loose within the created pouch and upon returning to refrigerated temperatures will not stick together. The resultant product is a non-spotted pouch with a loose, granular snus product inside.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method for preparing a portioned smokeless tobacco product, comprising:

providing units of a snus product to a wrapping material;

sealing the wrapping material around the units of snus; and cooling at least a portion of the snus product to a temperature of 0° C. or below prior to the sealing.

2. The method according to claim 1, wherein the sealing comprises heating.

3. The method according to claim 1, wherein the cooling comprises cooling the snus product to a temperature of −5° C. or below.

4. The method according to claim 3, wherein the cooling comprises cooling the snus product to a temperature of −10° C. or below.

5. The method according to claim 1, wherein the wrapping material is provided in a tube or tape form, and further comprising dividing the sealed wrapped snus product into separate units of sealed wrapped snus product.

6. The method according to claim 1, wherein the providing comprises:

placing the units of the snus product on a first sheet of a wrapping material in a chosen configuration; and covering the snus product on the first sheet of wrapping material with a second sheet of wrapping material.

7. The method according to claim 6, wherein the configuration is rectangular.

8. The method according to claim 7, wherein the configuration is square.

9. The method according to claim 6, wherein the configuration is circular.

10. The method according to claim 6, wherein the configuration is kidney-shaped.

11. The method according to claim 1, wherein the cooling comprises treating the snus product with cooled gas.

12. The method according to claim 1, wherein the cooling lasts at least 1 second.

13. The method according to claim 1, wherein the cooling lasts a maximum of 30 second.

14. The method according to claim 1, wherein the wrapping material is a non-woven fleece.

15. The method according to claim 1, wherein the cooling comprises use of an air-cooling conveyer.

16. The method according to claim 1, wherein the cooling comprises use of a chill roller.

17. The method according to claim 1, wherein the cooling comprises spray freezing.

18. The method according to claim 1, wherein the cooling lasts at least 2 seconds.

19. The method according to claim 1, wherein the cooling lasts at least 5 seconds.

20. The method according to claim 1, wherein the cooling lasts at least 10 seconds.

21. The method according to claim 1, wherein the cooling lasts at least 30 seconds.

22. The method according to claim 1, wherein the cooling lasts at least 45 seconds.

23. The method according to claim 1, wherein the cooling lasts at least 60 seconds.

24. The method according to claim 1, wherein the cooling lasts at least 90 seconds.

25. The method according to claim 1, wherein the cooling lasts at least 120 seconds.

26. The method according to claim 1, wherein the cooling lasts at least 3 minutes.

27. The method according to claim 1, wherein the cooling lasts at least 5 minutes.

28. The method according to claim 1, wherein the cooling lasts at least 10 minutes.

29. The method according to claim 1, wherein the cooling lasts at least 15 minutes.

30. The method according to claim 1, wherein the cooling lasts at least 20 minutes.

31. The method according to claim 1, wherein the cooling lasts at least 30 minutes.

32. The method according to claim 1, wherein the cooling lasts at least 45 minutes.

33. The method according to claim 1, wherein the cooling lasts a maximum of 45 seconds.

34. The method according to claim 1, wherein the cooling lasts a maximum of 60 seconds.

35. The method according to claim 1, wherein the cooling lasts a maximum of 90 seconds.

36. The method according to claim 1, wherein the cooling lasts a maximum of 120 seconds.

37. The method according to claim 1, wherein the cooling lasts a maximum of 3 minutes.

38. The method according to claim 1, wherein the cooling lasts a maximum of 5 minutes.

39. The method according to claim 1, wherein the cooling lasts a maximum of 10 minutes.

40. The method according to claim 1, wherein the cooling lasts a maximum of 15 minutes.

41. The method according to claim 1, wherein the cooling lasts a maximum of 20 minutes.

42. The method according to claim 1, wherein the cooling lasts a maximum of 30 minutes.

43. The method according to claim 1, wherein the cooling lasts a maximum of 45 minutes.

44. The method according to claim 1, wherein the cooling lasts a maximum of 60 minutes.

* * * * *

UNITED STATES PATENT AND TRADEMARK OFFICE

CERTIFICATE OF CORRECTION

PATENT NO. : 8,499,765 B2
APPLICATION NO. : 12/598727
DATED : August 6, 2013
INVENTOR(S) : Gary Fallon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 945 days.

Signed and Sealed this
Twenty-ninth Day of October, 2013

Teresa Stanek Rea

Teresa Stanek Rea
*Deputy Director of the United States Patent and Trademark Office*